US009881725B2

(12) United States Patent
Edwards et al.

(10) Patent No.: US 9,881,725 B2
(45) Date of Patent: Jan. 30, 2018

(54) ETHERNET MAGNETICS PACKAGE WIRE TERMINATIONS

(71) Applicant: Cisco Technology, Inc., San Jose, CA (US)

(72) Inventors: William Frank Edwards, Livermore, CA (US); Ki-Yuen Chau, Palo Alto, CA (US); Keith Frank Tharp, San Jose, CA (US); George Curtis, San Jose, CA (US); Kayen Lin, Shanghai (CN)

(73) Assignee: Cisco Technology, Inc., San Jose, CA (US)

( * ) Notice: Subject to any disclaimer, the term of this patent is extended or adjusted under 35 U.S.C. 154(b) by 189 days.

(21) Appl. No.: 14/550,256

(22) Filed: Nov. 21, 2014

(65) Prior Publication Data

US 2016/0148743 A1 May 26, 2016

(51) Int. Cl.

| | |
|---|---|
| ***H01F 27/02*** | (2006.01) |
| ***H01F 27/28*** | (2006.01) |
| ***H01F 27/29*** | (2006.01) |
| ***H01F 27/06*** | (2006.01) |
| ***H01F 41/10*** | (2006.01) |
| ***H01F 27/04*** | (2006.01) |
| ***H01F 27/30*** | (2006.01) |
| ***H01R 13/00*** | (2006.01) |

(Continued)

(52) U.S. Cl.

CPC ..... *H01F 27/06* (2013.01); *H01F 27/04* (2013.01); *H01F 27/2823* (2013.01); *H01F 27/2828* (2013.01); *H01F 27/292* (2013.01); *H01F 27/306* (2013.01); *H01F 41/10* (2013.01); *H01R 13/00* (2013.01); *H01R 13/719* (2013.01); *H01R 43/01* (2013.01); *H01F 17/062* (2013.01); *H01F 2017/0093* (2013.01); *H01F 2027/065* (2013.01); *H01R 4/023* (2013.01); *H01R 4/027* (2013.01); *H01R 24/64* (2013.01); *H01R 43/0221* (2013.01); *H01R 2107/00* (2013.01)

(58) Field of Classification Search

USPC ..... 336/192

See application file for complete search history.

(56) References Cited

U.S. PATENT DOCUMENTS 3,800,390 A 4/1974 Johnston
3,886,641 A 6/1975 Davis
(Continued)

FOREIGN PATENT DOCUMENTS

GB 1453636 A 10/1976

OTHER PUBLICATIONS

U.S. Appl. No. 13/930,570, filed Jun. 28, 2013.
(Continued)

*Primary Examiner* — Ronald Hinson

(57) ABSTRACT

In one implementation, an apparatus is configured to aid in the manufacturing or assembling of electronic surface mount packages. The apparatus includes a common mode choke base configured to support a common mode choke. The apparatus includes terminal contacts coupled to the common mode choke base. The terminal contacts are aligned with wires connected to the common mode choke. The apparatus includes a support member including a wire supporting portion aligned with the wires connected to the common mode choke and a central portion configured to support the common mode choke base.

20 Claims, 13 Drawing Sheets

(51) Int. Cl.

| | |
|---|---|
| ***H01R 43/01*** | (2006.01) |
| ***H01R 13/719*** | (2011.01) |
| *H01F 17/06* | (2006.01) |
| *H01F 17/00* | (2006.01) |
| *H01R 4/02* | (2006.01) |
| *H01R 24/64* | (2011.01) |
| *H01R 43/02* | (2006.01) |
| *H01R 107/00* | (2006.01) |

(56) References Cited

U.S. PATENT DOCUMENTS

| | | | | |
|---|---|---|---|---|
| 4,349,944 | A | 9/1982 | Fickes | |
| 5,656,985 | A | 8/1997 | Lu et al. | |
| 6,297,720 | B1 | 10/2001 | Lu et al. | |
| 6,297,721 | B1 | 10/2001 | Lu et al. | |
| 6,320,489 | B1 | 11/2001 | Lu et al. | |
| 6,344,785 | B1 | 2/2002 | Lu et al. | |
| 6,522,230 | B2 | 2/2003 | Hanato et al. | |
| 6,662,431 | B1 | 12/2003 | Lu et al. | |
| 6,777,619 | B1 | 8/2004 | Badinski et al. | |
| 9,093,794 | B2 | 7/2015 | Curtis et al. | |
| 2002/0164897 | A1* | 11/2002 | Liang | H01R 4/242 439/395 |
| 2004/0239465 | A1 | 12/2004 | Chen et al. | |
| 2011/0095847 | A1* | 4/2011 | Chen | H01F 17/062 333/175 |
| 2012/0090170 | A1 | 4/2012 | McCaskey | |
| 2012/0315794 | A1 | 12/2012 | Chen et al. | |
| 2013/0194766 | A1 | 8/2013 | Chen | |
| 2014/0036459 | A1 | 2/2014 | Gutierrez et al. | |
| 2014/0254094 | A1 | 9/2014 | Chang et al. | |
| 2014/0310953 | A1* | 10/2014 | McCaskey | H01R 43/015 29/749 |

OTHER PUBLICATIONS

PCT International Search Report and Written Opinion of the International Searching Authority dated Feb. 22, 2016 for corresponding PCT/US2015/058002.

"SMT Common Mode Chokes", for PoE Applications, Pulse Electronics, H603.B, Jul. 2011, pulseelectronics.com, 3 pages.

DataSheet, Pulse Electronics, CHK,SIN,10D,1:1,SM,TU, PS-2400.001-B, 23Z105SMNL, Rev. M12, Oct. 2013, pulseelectronics.com, 1 page.

"SMT Common Mode Chokes", for PoE Applications, Pulse Electronics, H604.C, Feb. 2012, pulseelectronics.com, 3 pages.

DataSheet, Pulse Electronics, CHK,SIN,10D,1:1,AM,TU, 23Z105SMFNL-10, PS-2755.001-A, Jun. 2014, www.pulseelectronics.com, 3 pages.

"Surface Mount Common Mode Chokes", Suited for LAN and Telecom Applications, Pulse Electronics, G002.P, www.pulseelectronics.com, Dec. 2012, 3 pages.

"Low Profile 10/100BASE-TX Transformer", SMD Single Port Low Profile 10/100BASE-TX Isolation Modules, Halo Electronics, Inc., Revised 3/2014REVB, retrieved from www.haloelectronics.com/pdf/discrete-lowprofile-100baset.pdf on Aug. 11, 2017, 2 pages.

* cited by examiner

ETHERNET MAGNETICS PACKAGE WIRE TERMINATIONS

TECHNICAL FIELD

This disclosure relates in general to the field of electronic surface mount packages, and more particularly, to systems and methods for assembling or manufacturing the electronic surface mount packages.

BACKGROUND

A choke is an inductor or inductive element that blocks high frequency signals, while passing lower frequency signals. In other words, the high frequencies are "choked." A common mode choke (CMC) is a choke that allows data signals to pass in differential mode but provides high impedance to common mode signals or noise. Wires coming from the CMC may be electrically coupled to pins of a package for connection to an electronic device.

A manual process may be used to attach the pins to the CMC. The wire may be wound around the pin by hand. The insulation may be removed from a portion of the wire. The pin and wire may be placed in a solder dip or otherwise soldered together. Optionally, silicon may be added to the soldered pin and wire pair. The resulting connection of the pins and wires may resemble pigtails. In addition, the wires may be very close together, which makes soldering difficult. Challenges remain in providing a less labor intensive process for reliably connecting the wires and pins.

BRIEF DESCRIPTION OF THE DRAWINGS

Example embodiments of the present embodiments are described herein with reference to the following drawings.

DESCRIPTION OF EXAMPLE EMBODIMENTS

Overview

In one implementation, an apparatus is configured to aid in the manufacturing or assembling of electronic surface mount packages. The apparatus includes a common mode choke base configured to support a common mode choke. The apparatus includes terminal contacts coupled to the common mode choke base. The terminal contacts are aligned with wires connected to the common mode choke. The apparatus includes a support member including a wire supporting portion aligned with the wires connected to the common mode choke and a central portion configured to support the common mode choke base.

In another implementation, an apparatus includes terminal contacts, a support member, and an adjustable tensioner. The terminal contacts are coupled to a common mode choke, and the plurality of contacts are aligned with wires connected to the common mode choke. The support member includes a wire supporting portion aligned with the wires connected to the common mode choke and a central portion configured to support the common mode choke base. The adjustable tensioner is configured to move a comb of the wire supporting portion to frictionally hold the wires.

Example Embodiments

Figure 1A:
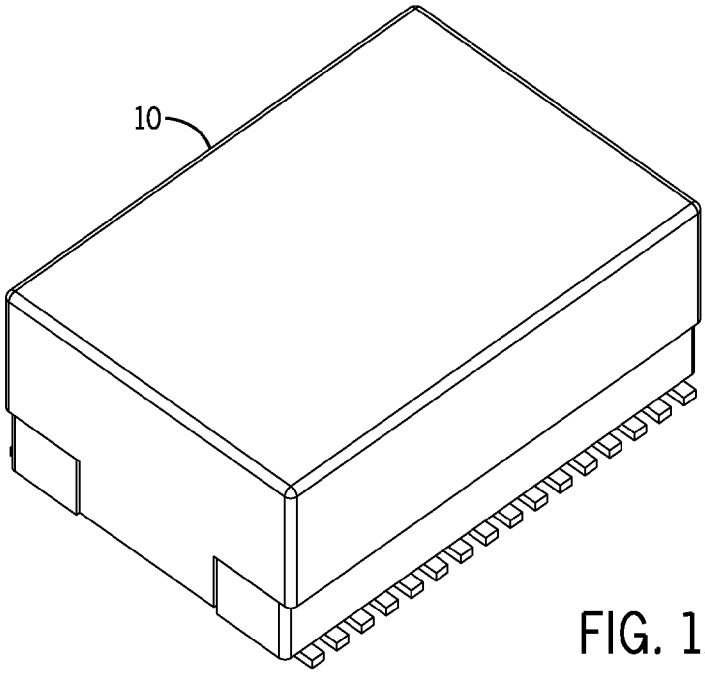
FIG. 1A illustrates an example choke package.

FIG. 1A illustrates an example choke package. The choke package may be a surface mount device (SMD) that is mounted or placed directly on a printed circuit board (PCB) using surface mount technology (SMT). SMDs are typically smaller than components of the alternative through hole technology because SMDs have smaller pins or no pins at all.

Figure 1B:
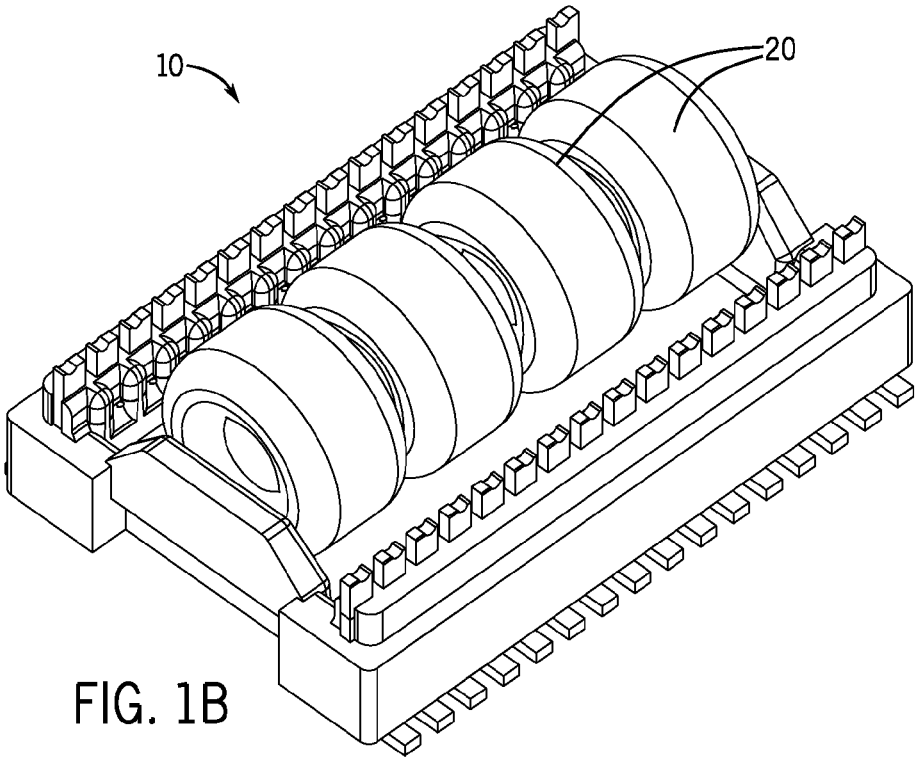
FIG. 1B illustrates an example interior of the choke package of FIG. 1A.

FIG. 1B illustrates an example interior of the choke package 10 of FIG. 1A. The choke package may include one or more inductors 20. The inductors 20 may include a coil of wire wrapped around a core of a ferrite material or magnetic material. The ferrite material or magnetic material may be a toroid or donut-shaped as shown in FIG. 1B. The impedances of the inductors 20 may vary as a function of frequency such that high frequencies are blocked or choked but lower frequencies pass with low or no attenuation. The inductors 20 may operate as a common mode choke in which two coils are wrapped around the core. Each coil passes a current that is substantially equal and opposite of the current of the other coil. The magnetic fields of the currents are additive and create a high impedance to the common mode signal, which may include noise or other unwanted components.

The choke package 10 may be electrically connected to an integrated connector. One example integrated connector (e.g., RJ-45) is specified by a protocol such as the Institute for Electrical and Electronics Engineers (IEEE) standard 802.3 known as Ethernet. The choke package 10 may be connected to a receptacle of the integrated connector and a physical layer (PHY), which may include one or more of a transceiver, encoders, decoders, phase lock loops or other circuits or components. The integrated connector may be configured for power over Ethernet.

Figure 2:
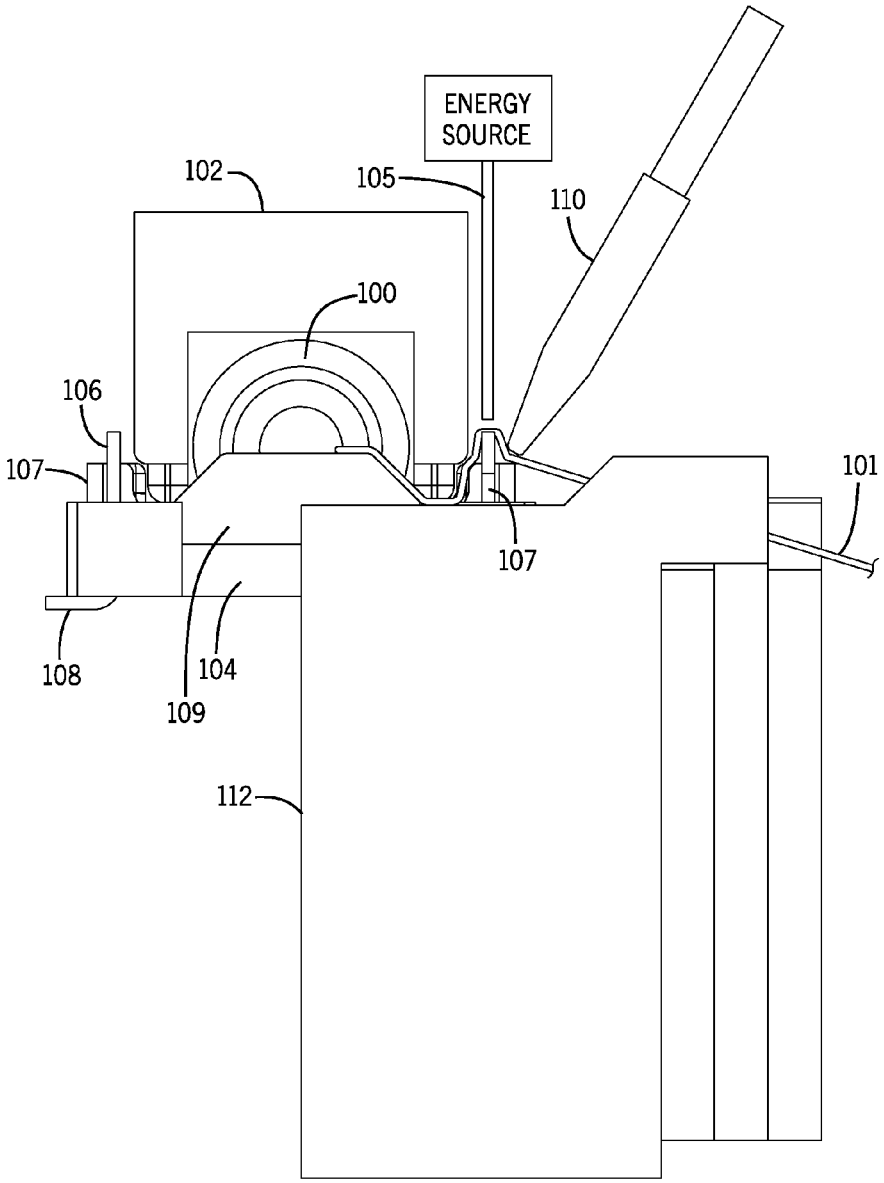
FIG. 2 illustrates an example cross-sectional view of a choke package and support assembly for wire termination.

FIG. 2 illustrates an example cross-sectional view of a choke package and support assembly for wire termination. The system includes a common mode choke (CMC) 100, one or more wires 101, a push tongue 102, a CMC base 104, a wire form tool 110, and a support assembly 112. The CMC base 104 includes at least a terminal contact 106 and a surface mount lead 108. The terminal contact 106 is aligned with a non-contact energy source 105. Additional, different, or fewer components may be included.

The CMC 100 may be shaped as a toroid. The wires 101 are mechanically and electrically coupled to the CMC 100. The CMC 100 needs to be secured in place and may be coupled to the CMC base 104 using an adhesive or a mechanical securing device. The CMC 100 is positioned on an edge such that the primary axis of the CMC 100 is perpendicular to the primary axis of the CMC base 104 or the primary axis of the underlying PCB. The CMC 100 may be connected to twisted pairs wound in parallel to accommodate two gigabit Ethernet lanes per each ferrite toroid. In one example, there are four lanes per gigabit Ethernet and eight lanes per two gigabit Ethernet ports, such that four ferrite toroids are used for two gigabit Ethernet ports.

The CMC base 104 may be formed of a material such as plastic, resin, silicon, or any polymer. The material may be hard or soft. The CMC base 104 includes two raised portions 107 that extend substantially along the entire length of the CMC base 104. The terminal contact 106 extends through the raised portions 107 through the CMC base 104 and out the bottom of the CMC base as the surface mount lead 108. The terminal contact 106, and other similar contacts, are aligned with the wires 101 connected to the CMC 100. The CMC base 104 may include one or more grooves associated with each of the one or more wires 101 to aid in alignment of the wires 101.

The CMC base 104 includes a center portion 109 configured to support the CMC 100. Example ranges for the dimensions for the CMC base 104 include a vertical cross section of 0.25 inches to 1.0 inch by 0.2 inch to 0.6 inches (e.g., approximately 0.53 inches by 0.38 inches) and a height in the range of 0.1 inches to 0.4 inches (e.g., 0.23 inches).

The support assembly 112, which will be discussed in more detail below, includes a rigid portion and an elastic portion that cooperate to support and grip the one or more wires 101. The support assembly 112 is a wire supporting portion aligned with the wires 101 connected to the CMC 100.

The wires 101 may be various sizes. In one example, the wires 101 are in the range of 20-60 gauge wires (e.g., 40 gauge). Other sizes may be used. The wires may be magnetic. The wires may be formed of two materials such as a core material and a plating material. The core material may have a low melting temperature and the plating material may have a higher melting temperature. The core material may be copper. The plating material may be tin or any solderable plating material. In one alternative, the plating includes nickel. The plating may have a predetermined width. Example widths include 1 micron to 8 microns.

The wire form tool 110 may be operated by hand or through an actuator. The wire form tool 110 may be made of a variety of materials. Example materials include silicone rubber or other thermoplastic. The wire form tool may be tapered. The push tongue 102 may be formed of metals or polymers. The push tongue 102 may be shaped to fit between the raised portions 107 and the CMC 100. The one or more wires 101 are positioned to receive the wire form tool 110, and the wire form tool 110 presses the one or more wires 101 against the terminal contact 106 and/or the CMC base 104. The one or more wires 101 are positioned to receive the push tongue 102, and the push tongue 102 presses the one or more wires 101 against the terminal contact 106 and/or the CMC base 104. The CMC base 104 and the push tongue 102 may include rounded portions formed from plastic or another material with a smaller hardness than that of the CMC base 104 so as to scratch or damage the CMC base 104.

The wire form tool 110 and the push tongue 102 insure that the wires 101 are held in place so that the energy source 105 is precisely aligned with the wire 101. The energy source 105 cuts the wire 101 and welds the wire 101 to the terminal contact 106. The energy source 105 may also melt or remove the insulation from the wire 101. Because the core material of the wire 101 has a melting temperature lower than the melting temperature of the plating material of the wire 101, the energy delivered may be reduced so as to minimize copper wire diameter reduction. Copper wire diameter reduction is a common problem when using the existing solder dip process and may cause broken wires and, as a consequence, electrical open circuits.

Figure 3:
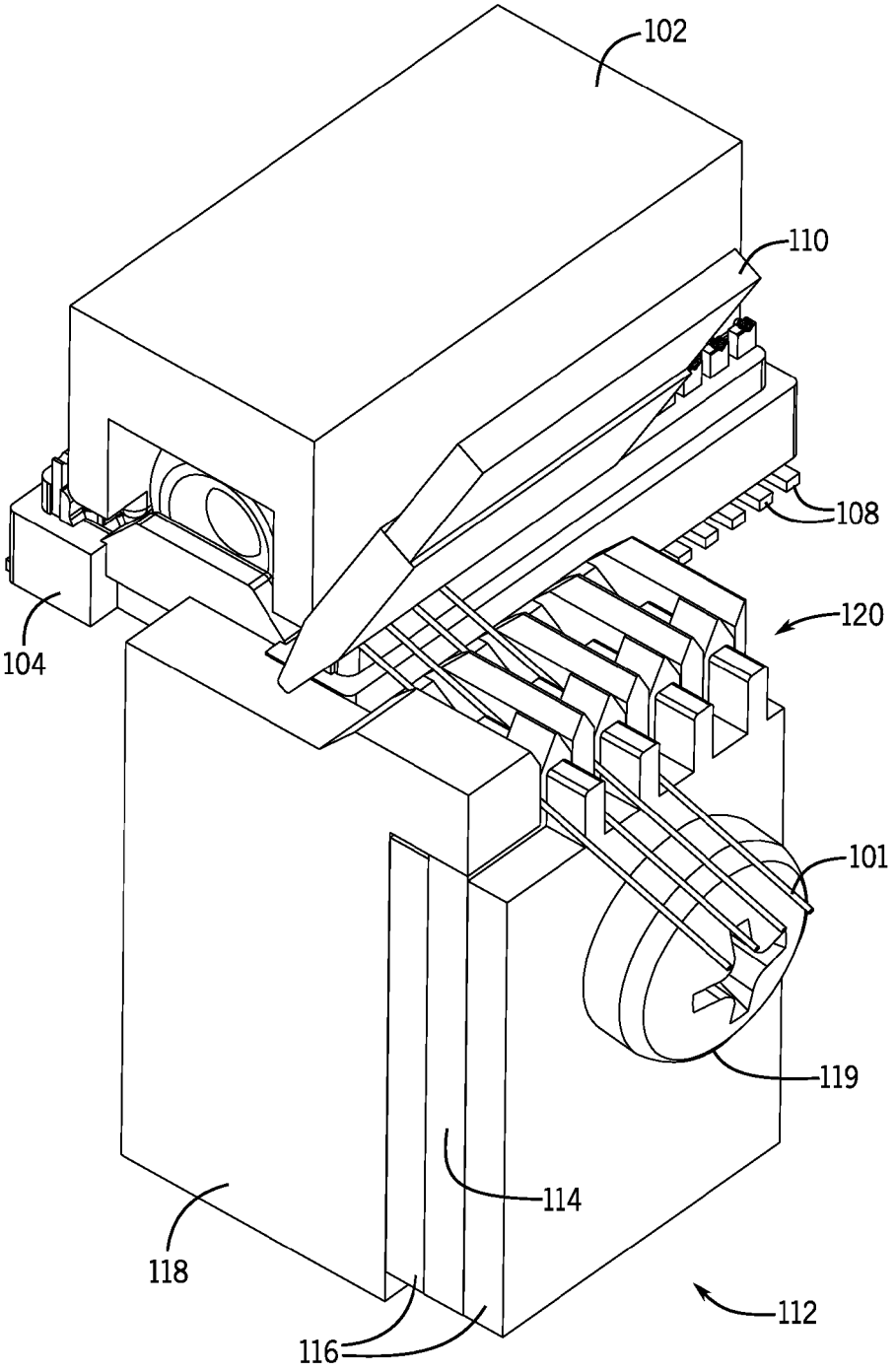
FIG. 3 illustrates an example perspective view of the choke package and support assembly for wire termination.

FIG. 3 illustrates an example perspective view of the choke package and support assembly for wire termination. The system includes multiple wires 101 connected to the choke package, the push tongue 102, the CMC base 104 including multiple surface mount leads 108, the wire form tool 110, and the support assembly 112. The support assembly 112 includes a deformable portion 114, a non-deformable portion 116, a base portion 118, a tensioner 119 and a comb holder 120. Additional, different, or fewer components may be included.

The deformable portion 114 may be formed of rubber, foam, or an elastomer. The deformable portion 114 may have a low Young's modulus and/or a viscoelasticity that allows the deformable portion 114 to change shape under force from the non-deformable portion 116. The non-deformable portion 116 may be formed from metal, hard plastic, or another material having a high Young's modulus.

The non-deformable portion 116 and the deformable portion 114 may brought into contact or pressed together under pressure by the tensioner 119. The non-deformable portion 116 and the deformable portion 114 may be shaped as a comb to form the comb holder 120, which may be referred to as a frictional holder. Each of the "teeth" of the comb corresponds to one of the wires 101. The tensioner 119 may include a screw or wing nut that presses the two sides of the non-deformable portion 116 to sandwich the deformable portion 114, which causes the top of the deformable portion 114 to expand and press against one or more of the wires 101. The wires 101 may be held in place between the deformable portion 114 and the base portion 118.

The base portion 118 directly supports the CMC base 104. The base portion may be formed of any material. In FIG. 3 only part of the base portion 118 is illustrated. The base portion 118 may extend the full length and past the CMC base 104 in both directions. Likewise, the wire form tool 110 and the push tongue 102 may extend the length of the CMC base 104.

Figure 4:
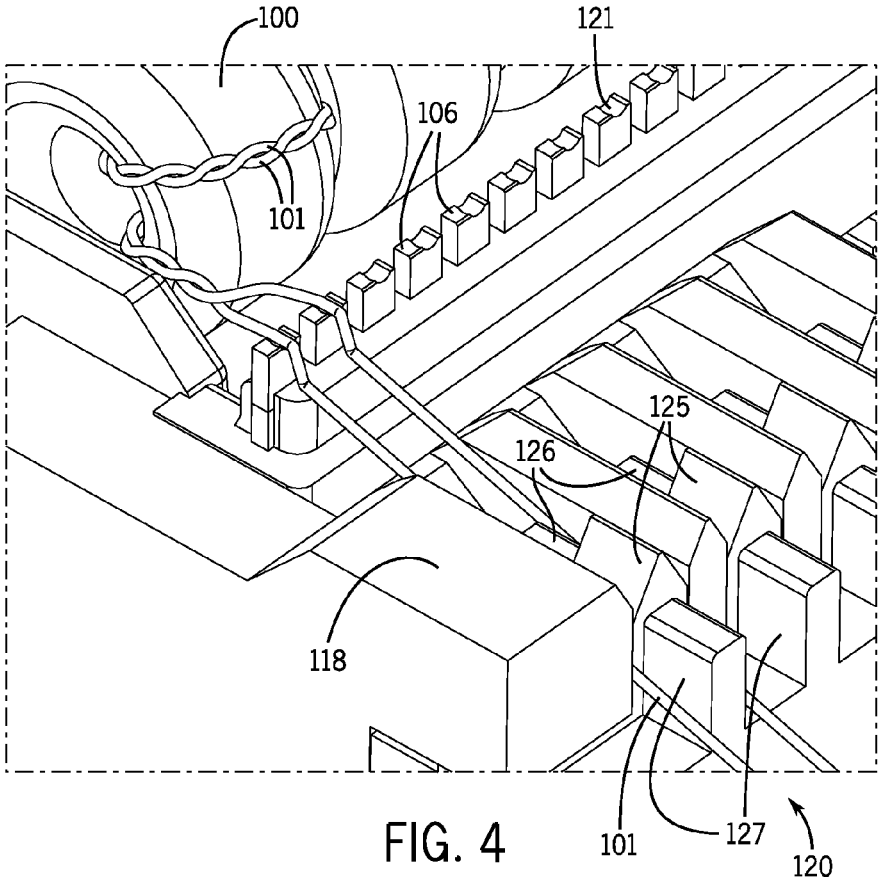
FIG. 4 illustrates an example of multiple terminal contacts and wire alignment for a choke package.

FIG. 4 illustrates an example of multiple terminal contacts and wire alignment for a choke package. The view of FIG. 4 illustrates the CMC 100, multiple terminal contacts 106, and the comb holder 120 for alignment of the wires 101.

The terminal contacts 106 include an alignment portion 121. The comb holder 120 includes a primary comb 125, a secondary comb 126, a tertiary comb 127, and the base portion 118. Additional, different, or fewer components may be included.

The comb holder 120 may be configured to frictionally hold the wires in place. The primary comb 125 extends from the deformable portion 114 and may be formed from the same material. The primary comb 125 may have a triangular cross section.

The secondary comb 126 and the tertiary comb 127 extend from the non-deformable portion 116 and may be formed from the same material. The secondary comb 126 and the tertiary comb 127 may include a rectangular cross section.

Example dimensions for the comb holder 120 may be optimized for a 0.8 millimeters from the center of one pin of the SMD to the center of an adjacent pin of to the SMD. The package may include any number of CMCs 100. Each of the CMCs may correspond to 8 of the terminal contacts 106 (four connections on the input side of the CMC and four connections on the output side of the CMC). FIG. 4 illustrates that the terminal connections (e.g., terminal contacts 106) are arranged linearly. Each terminal contact 106 corresponds to one wire 101, and each pair of wires corresponds to a section of the comb holder 120. The pair of wires may be a twisted pair or otherwise wrapped around one another. The twisted pair of wires may be coiled around the CMC and the separated between the CMC 100 and the terminal contact 106. One of the wires from the twisted pair may be aligned with one of the terminal contacts 106 and another one of the wires may be aligned with an adjacent one of the terminal contacts 106.

The arrangement of the row of terminal connections 106 allows the signals with the common mode noise to all enter at one row of package pins and the clean filtered signals to all exit the other row of the package that is not shown in FIG. 4. This promotes electrical isolation in the printed circuit board trace routing.

Figure 5:
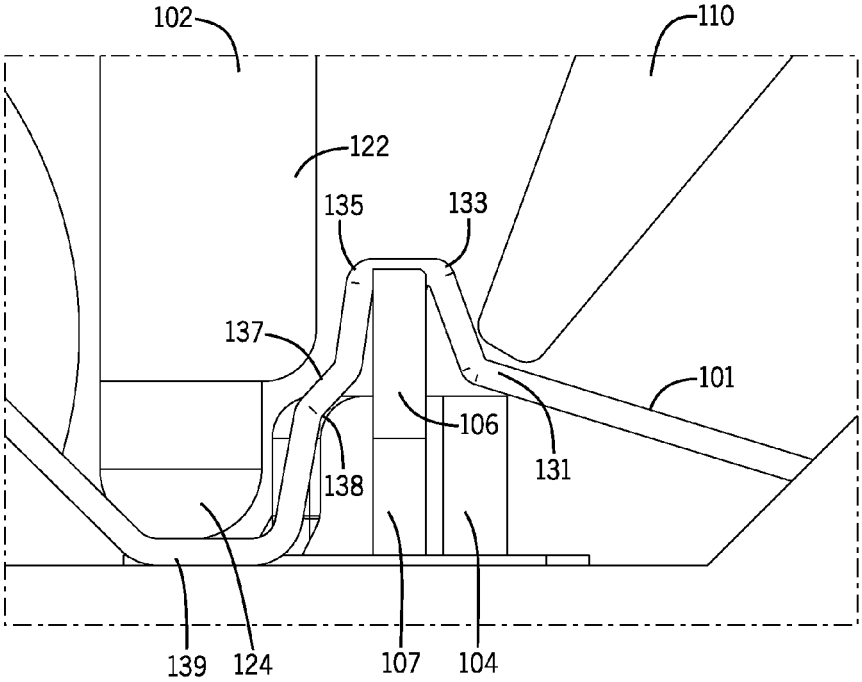
FIG. 5 illustrates an example detailed cross-sectional view of a terminal contact and wire alignment.

FIG. 5 illustrates a detailed cross-sectional view of the terminal contact 106 and wire alignment. The view includes the push tongue 102, the CMC base 104, and the wire form tool 110. In the example illustrated by FIG. 5, the wire 101 includes a first angled portion 131, a second angled portion 133, a third angled portion 135, a fourth angled portion 137, a fifth angled portion 138, and a sixth angled portion 139. Additional, different, or fewer components may be included.

The push tongue 102 includes a frame 122 and an abutment portion 124. The frame 122 and the abutment portion 124 may be formed of different materials. For example, the frame 122 may be metal and the abutment portion 124 may be rubber or foam. The abutment portion 124 is shaped to gently push and firmly hold the wire 101 against the base portion 104. Similarly, the wire form tool 110 is shaped to gently push and firmly hold the wire 101 against the base portion 104.

The wire form tool 110 and the abutment portion 124 cause the wire 101 to become angled or kinked. Thus, the wire 101 may be deformed to have multiple angled portions. The first angled portion 131 is caused by the wire form tool 110 on the comb holder 120 side of the terminal contact 106. The second angled portion 133 and the third angled portion 135 are formed as the wire 101 is pulled taught against the terminal contact and wire 101 bends across the top surface of the terminal contact 106. The raised portion 107 includes a groove 138. As the wire 101 is pulled into the groove 138 by the abutment portion 124, the fourth angled portion 137 and the fifth angled portion 138 are formed. Finally, the curved path of the wire 101 under the abutment portion 124 toward the CMC 100 is a sixth angled portion 139.

Figure 6:
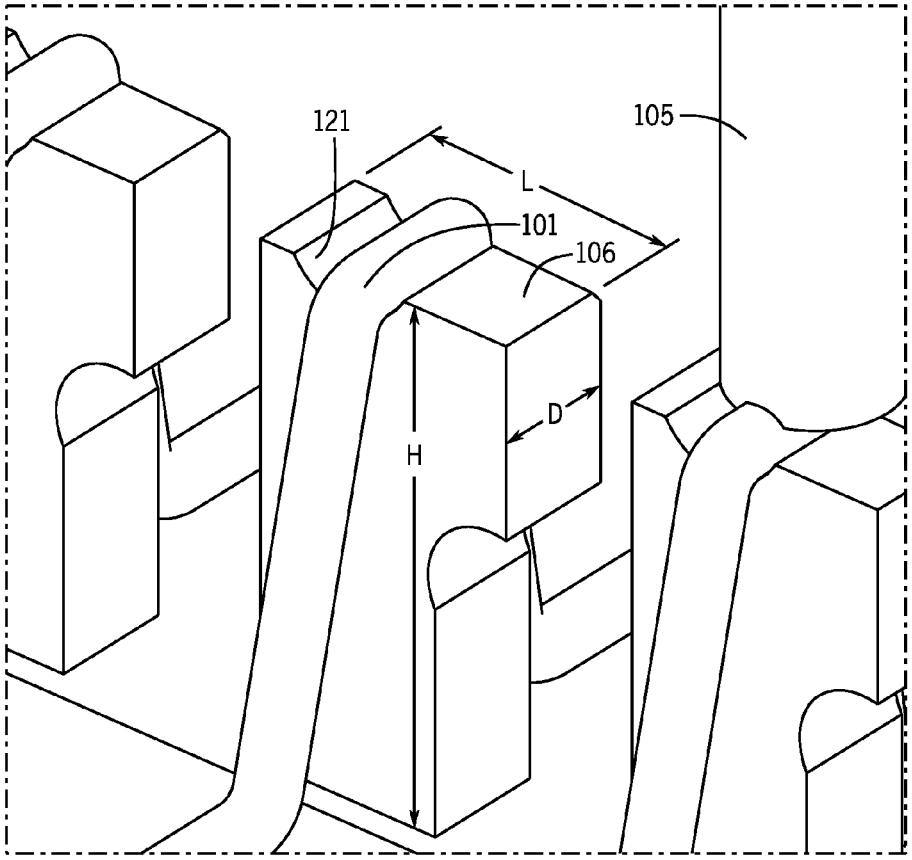
FIG. 6 illustrates an example detailed perspective view of terminal contacts and a non-contact energy source.

FIG. 6 illustrates a detailed perspective view of terminal contacts 106 and a non-contact energy source 105. The view illustrates a terminal contact 106 including the alignment portion 121 supporting the wire 101 in alignment with the non-contact energy source 105. Additional, different, or fewer components may be included.

The alignment portion 121 may have a concave shape that extends into the terminal contact 106. The alignment portion 121 is shaped to receive, support, and hold the wires 101. The concave portion may be sized as a function of the size of the wire 101. The width of the alignment portion 121 may be a function of the diameter of the wire 101. In one example, the width of the alignment portion 121 is 30%-80% larger than the width of the wire 101. In one alternative, the alignment portion 121 is predetermined percent of width of the contact terminal 106.

Other example ranges for the dimensions for the terminal contact 106 and the alignment portion 121 may be user configurable. The depth (D) of the terminal contact 106 may be 0.01 to 0.03 inches (e.g., 0.024 inches) or another value. The width (W) of the terminal contact 106 may be 0.02 to 0.05 inches (e.g., 0.021 inches) or another value. The height (H) of the terminal contact 106 may be 0.1 to 0.3 inches or another value. The curvature of the concave portion may have a radius of curvature of 0.001 to 0.03 inches (e.g., 0.005 inches) or another value.

The energy device 105 may be a laser device, an x-ray emitter, an electron beam emitter or another type of non-contact energy source such as heated air. The energy device 105 may emit a laser beam or other transmission of energy that is sufficient to melt and cut the wire 101. The energy device 105 may emit heat sufficient to melt and cut the wire 101.

In one example, the energy device 105 strips the insulation from the wire 101, cuts the wire 101, and welds the wire 101 to the contact terminal 106. In another example, the wire 101 is already stripped of insulation. In another example, the wire 101 is already cut. The energy device 105 may send a single pulse per wire or multiple pulses. When a single pulse is used, the single pulse may strip, cut, and weld the wire 101. When multiple pulses are used one pulse may strip and weld the wire 101 and another pulse may cut the wire 101. In one example, a first pulse strips the wire 101, another pulse welds the wire 101, and a third pulse cuts the wire 101. The multiple pulses may have different amounts of power. The multiple pulses may have different frequency depending on the desired function.

Figure 7:
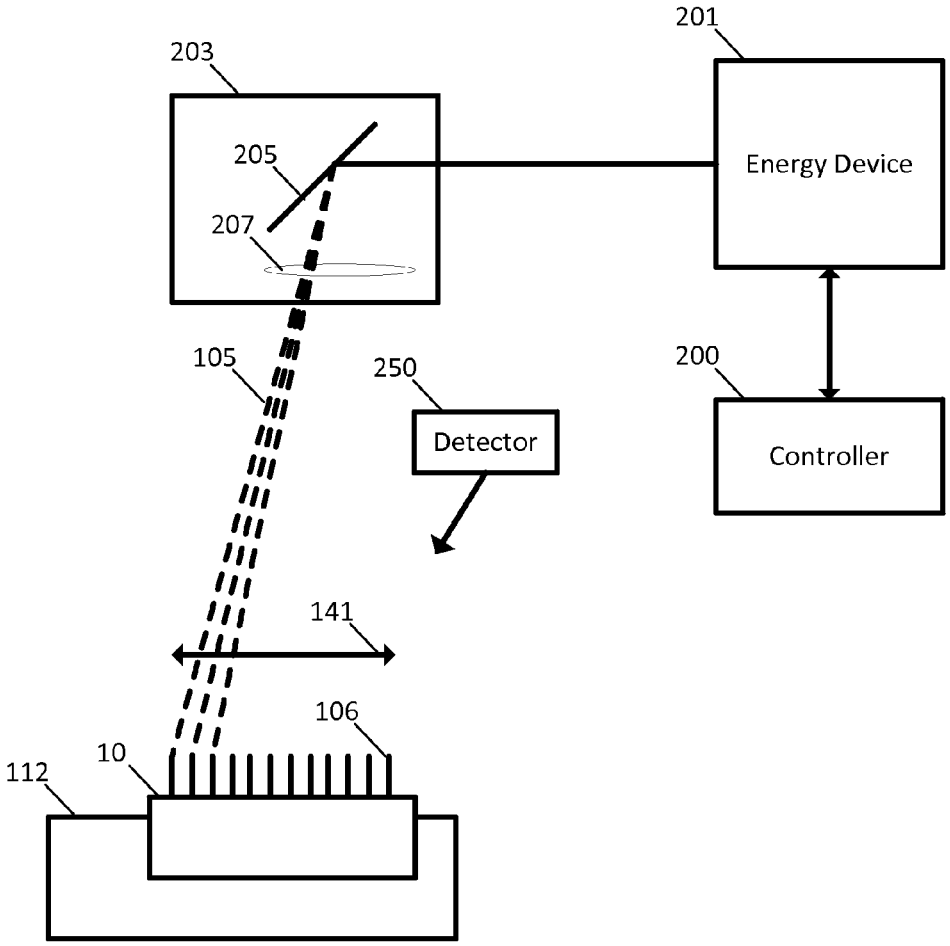
FIG. 7 illustrates an example non-contact energy source for termination of the wires of the choke package.

FIG. 7 illustrates a system including example non-contact energy source 105 for termination of the wires of the choke package 10. The system includes a controller 200, an energy device 201, an optics device 203, and the choke package 10. The choke package 10 is supported by support assembly 112. The optics device 203 may include at least one mirror 205 and at least one lens 207. The system may optionally include a detector 250. Additional, different, or fewer components may be included.

The controller 200 may execute instructions configured to operate the energy device 201. The instructions may include a schedule for generate one or more laser pulses. The instructions may specify the power level for the pulses, wavelength for the pulses, or frequency for the pulses. The controller 200 may include a user interface for a user to manually cause the energy device 201 to emit laser pulses. A pulse or set of pulses may correspond to each of the terminal contacts 106.

The laser pulses may be steered by the optics device 203. The mirror 205 may be rotated to steer the pulses from one terminal contact to the next. The controller 200 may generate commands for a stepper motor that rotates the mirror 205. The stepper motor and the mirror 205 may be configured to rotate to cause the pulse the travel at any point along the span 141. The lens 207 may focus the laser pulses.

The user may visually inspect the wires 101 to make sure the wires 101 are in place (e.g., in the alignment portion 121). Alternatively, the detector 250 may optically detect the location of the wires 101. In one example, the detector 250 may be a camera. The controller 200 may analyze video (e.g., feature extraction or edge detection) to determine when the wires 101 are correctly place in the concave portion. In another example, the detector 250 is a simpler optical detector (e.g., scanner). The concave portion may include an indicator such as a reflective sticker, a bar code, or a quick response code that can be detected when the wire 101 is out of place. When the wire 101 is in place, the wire 101 covers the indicator.

Figure 8:
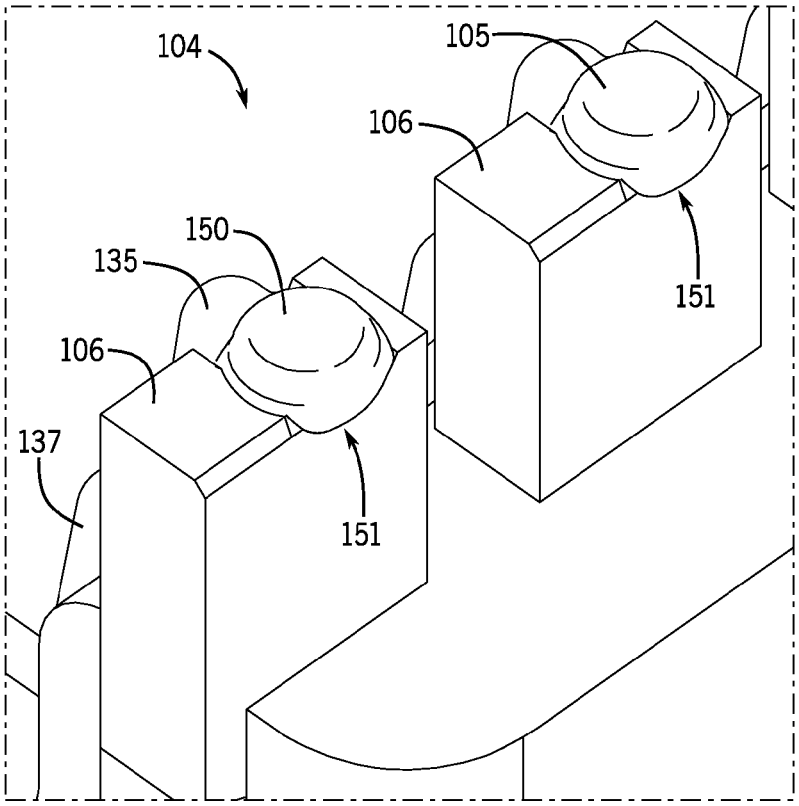
FIG. 8 illustrates an example terminal weld of the wires of the choke package.
Figure 9:
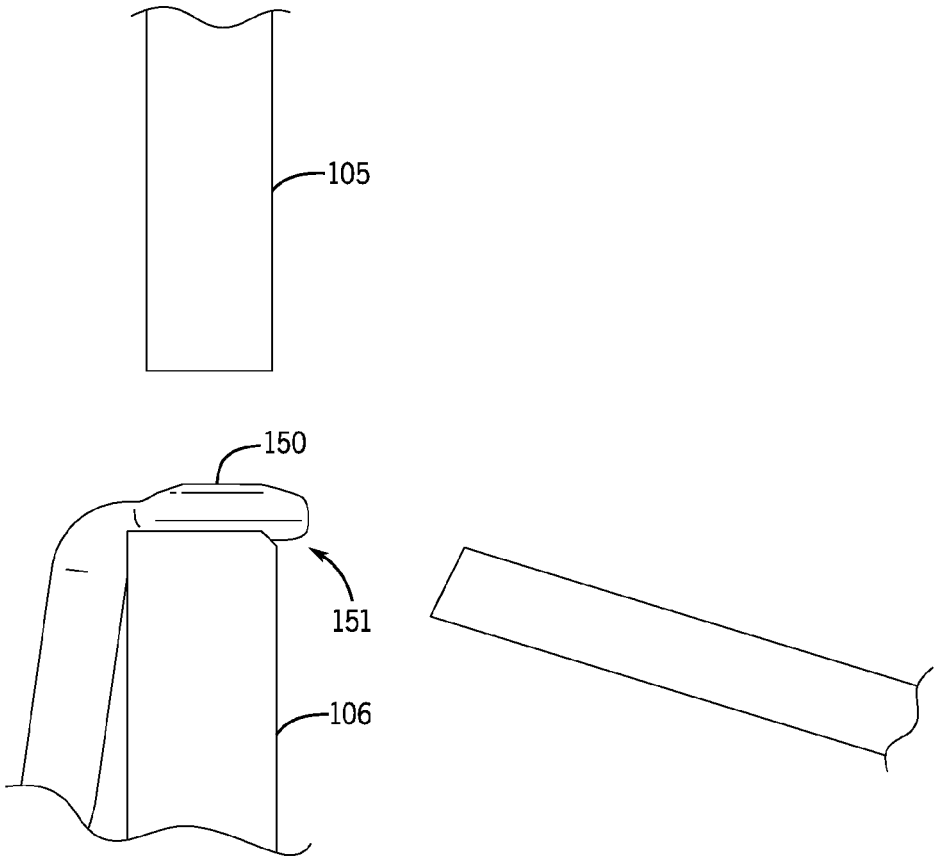
FIG. 9 illustrates an example side view of the terminal weld of FIG. 8.

FIG. 8 illustrates an example terminal weld 150 of the wires of the choke package. The terminal weld includes an overhang portion 151 that extends past the terminal contact 106. The terminal contact 106 supports the wire during the termination process. FIG. 9 illustrates an example side view of the terminal weld 150 of FIG. 8.

The weld 150 resulting from the termination process extends past and overhangs an edge of the one of the terminal contact 106. The overhang portion 151 of the weld 150 occurs because at least part of the termination process occurs away from the terminal contact 106 in the air. The air around the overhanging wire allows the welding and cutting processes reach a higher energy level (e.g., temperature).

The melting plating (e.g., tin) is wicked into the rest of the weld 150. The melted or melting plating flows away from the cut portion of the wire to mechanically and electrically connect the weld 150 to the terminal contact 106.

The weld 150 may be a direct metallurgical bond. A direct metallurgical bond may occur through the material included in the wire itself. No soldering paste is used. The plating of the wire allows for the weld 150 to form.

The size of the overhang portion 151, the distance between the far edge of the overhand portion and the terminal contact 106, may be a function of any combination of the plating material, the position of the laser, and the temperature of the termination process. The user may select the plating material, the position of the laser, and/or the temperature in order to adjust the size of the overhand portion 151. The size of the overhang portion 151 may be less than a predetermined distance. Examples for the predetermined distance include 0.1 millimeters, 0.13 millimeters, and 0.2 millimeters. Other values are possible. The size of the overhang portion 151 may be shorter than a smallest length possible to cut with hand tools (e.g., scissors, tweezers, wire cutters).

Figure 10:
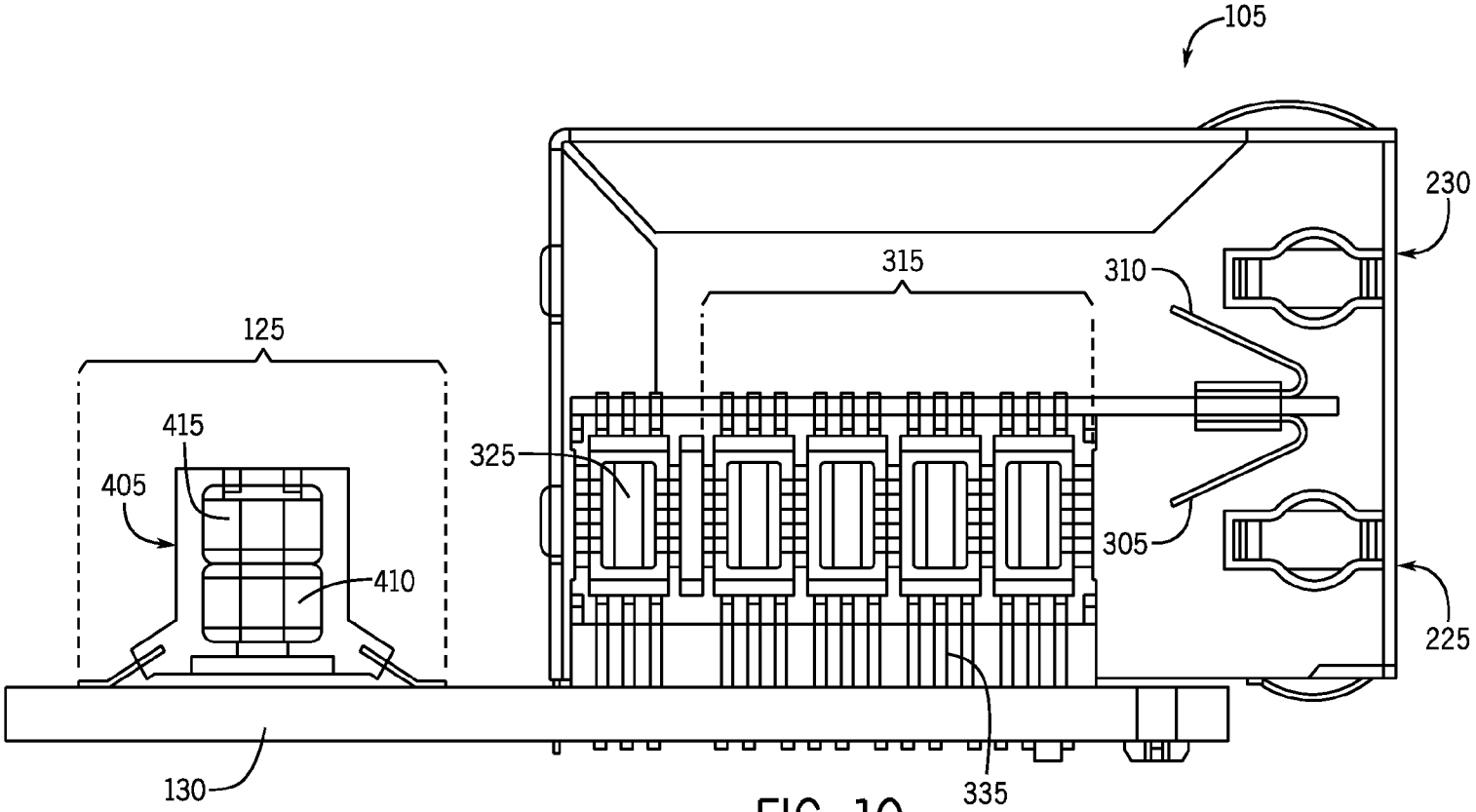
FIG. 10 illustrates another example choke package.

FIG. 10 illustrates another example choke package. The choke package may include an integrated connector 105 including first leaf connectors 305, second leaf connectors 310, a set of transformers 315, a first receptacle 225, and a second receptacle 230. A transformer 325 may be a power over Ethernet (POE) transformer separated from the circuit board 130 by a vertical space 335.

First leaf connectors 305 may correspond to first receptacle 225 and may connect signal wires from a jack (e.g., RJ-45) plugged into first receptacle 225. Similarly, second leaf connectors 310 may correspond to second receptacle 230 and may connect signal wires from a jack (e.g., RJ-45) plugged into second receptacle 230. The set of transformers 315 may be configured and tuned to block ground currents corresponding to first receptacle 225 or the second receptacle 230. The ground currents may be blocked in order to mitigate any electrical shock hazards to people who may come into contact with the device. While the set of transformers 315 is shown to respectively include four or five transformers, they are not so limited and may include any number of transformers.

Vertical space 335 may provide a volume where the choke could be located if it were contained in first integrated connector 105. However, because the choke may be external to first integrated connector 105, consistent with embodiments of the disclosure, vertical space 335 may be eliminated to, for example, give the connector structure a lower profile on circuit board 130.

The choke structure may comprise a choke 405 that may comprise a first choke coil 410 and a second choke coil 415. First choke coil 410 and second choke coil 415 may be configured for high electrical performance with toroidal ferrites for example. While choke 405 is shown to include two coils (e.g. first choke coil 410 and second choke coil 415) choke 405 is not so limited and may include any number of coils. For example, the ratio of choke coils to transformers may be 1:2 as shown in FIG. 4 or may comprise any ratio (e.g. 1:1.) Choke structure 400 may be located in choke structure space 125 or in any location on circuit board 130. Choke 405 may correspond to first receptacle 225 and may be electrically connected to first plurality of transformers 315 through circuit board 130. Other chokes may be included on circuit board 130 and may correspond to other receptacles in first integrated connector 105 in a similar fashion. Choke 405 may comprise a common-mode choke. A common-mode choke may comprise two coils that may be wound on a single core (e.g. first choke coil 410 or second choke coil 415) and may be useful for EMI and Radio Frequency interference (RFI) prevention from, for example, power supply lines and other sources. A common-mode choke may pass differential currents (e.g. equal but opposite), while blocking common-mode currents.

Figure 11:
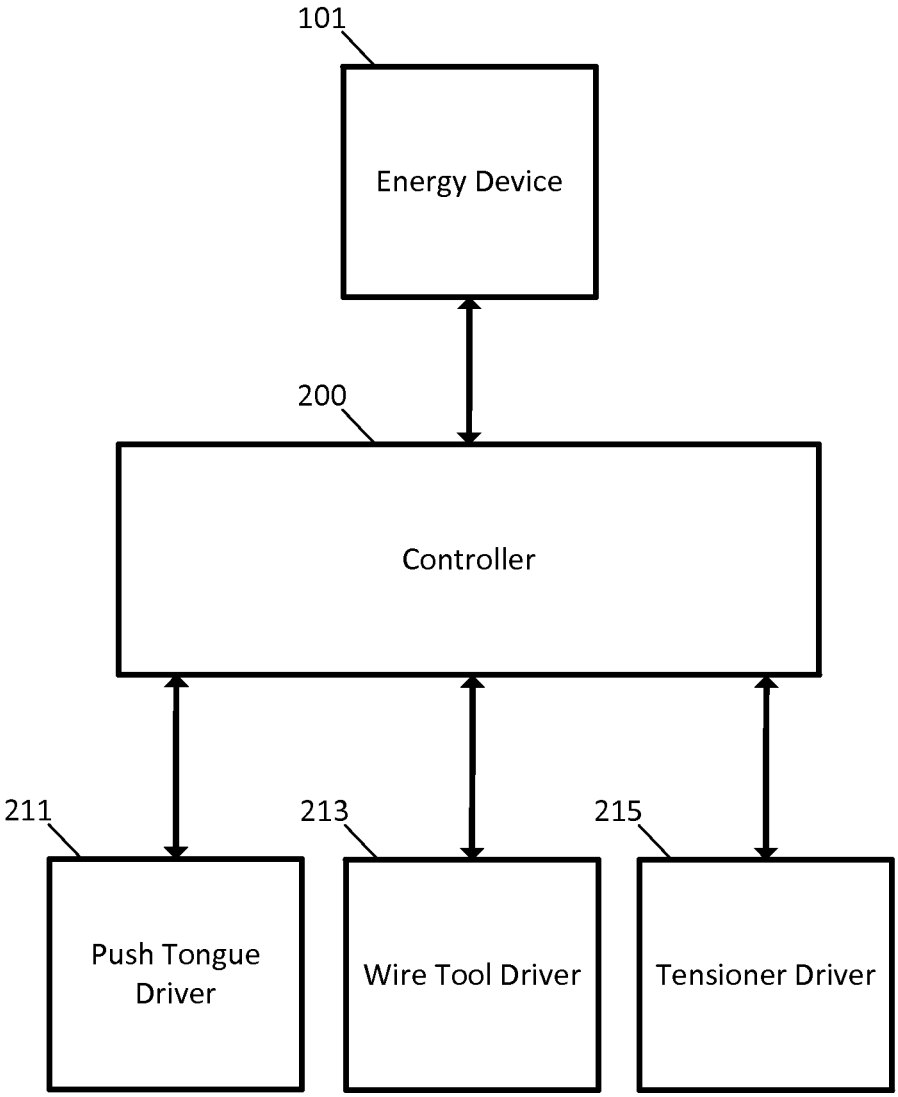
FIG. 11 illustrates an example control system for manufacturing a choke package.
Figure 12:
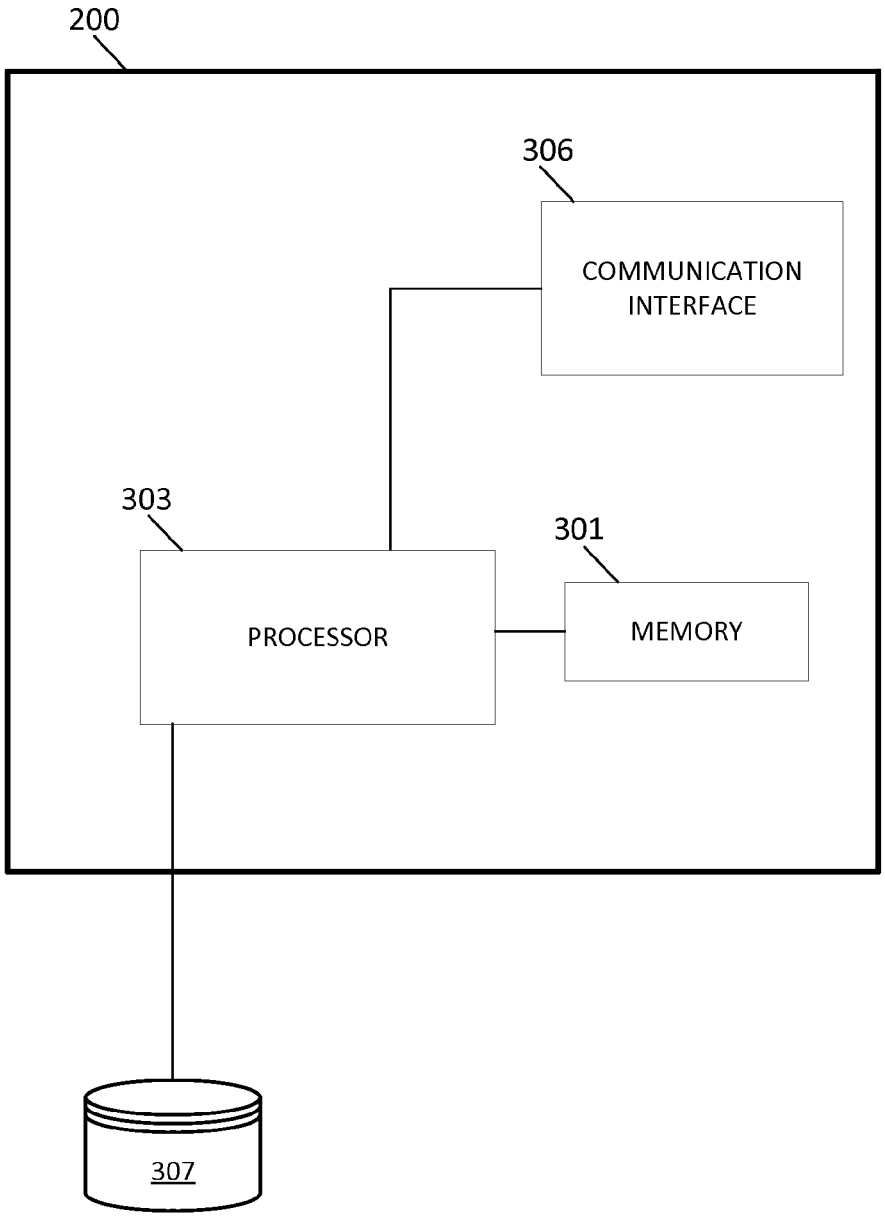
FIG. 12 illustrates an example controller for the control system of FIG. 11.
Figure 13:
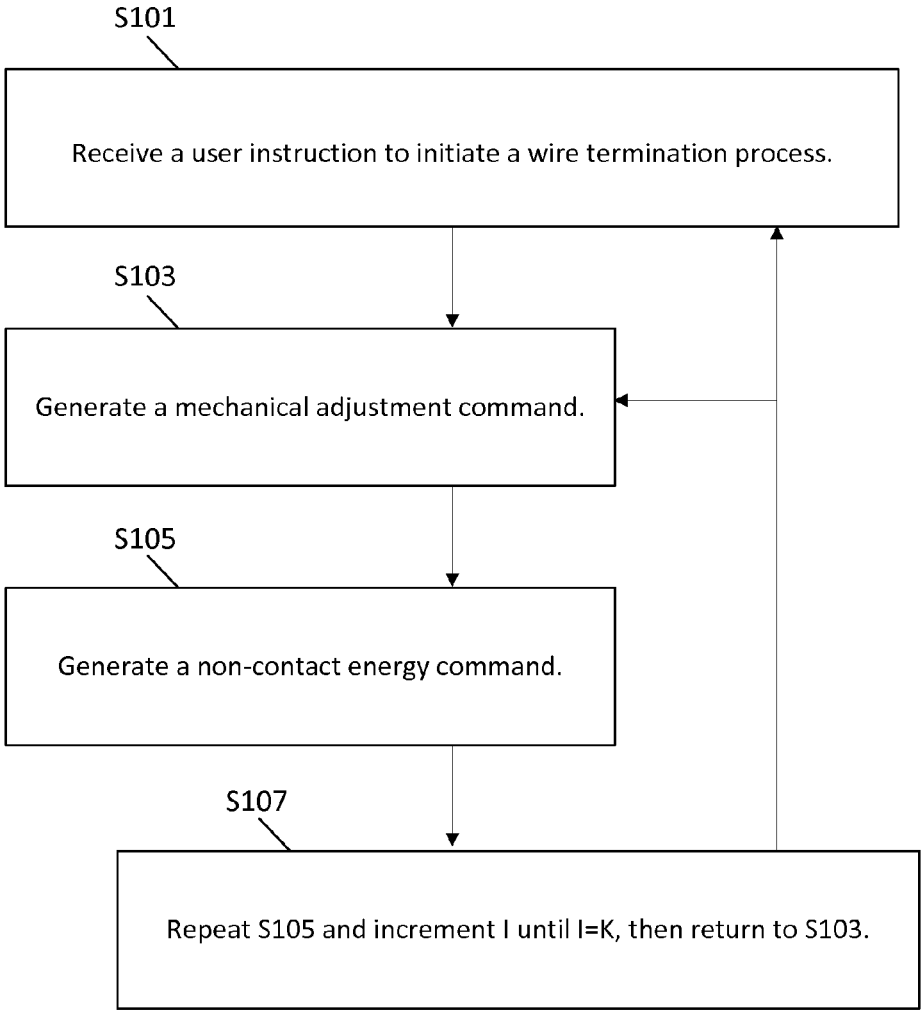
FIG. 13 illustrates an example flowchart for the operation of the controller of FIG. 12.

FIG. 11 illustrates an example control system for manufacturing a choke package. The control system may include a controller 200, the energy device 101, and one or more of push tongue driver 211, a wire tool driver 213, and/or a tensioner driver 215. Additional, different, or fewer components may be included. FIG. 12 illustrates an example controller 200 for the control system of FIG. 11 or the system of FIG. 7. The controller 200 includes at least a memory 301, a controller 303, and a communication interface 306. Additional, different, or fewer components may be provided. FIG. 13 illustrates an example flowchart for the control system. Additional, different, or fewer acts may be provided. The acts are performed in the order shown or other orders. The acts may also be repeated.

At act S101, the controller 200 or the communication interface 306 receives a user instruction to initiate a wire terminal process. The user instruction may be a start command. The user instruction may specify parameters such as the number of pins or terminal contacts to weld, the temperature or wavelength to use, the plating material of the wires to adjust the non-contact energy, or a time to begin the process. The user instruction may indicate that the user has made a visual inspection of the terminal contact and the wire and confirms the materials are in the correct alignment. The instructions may be stored in the memory 301.

At act S103, which is optional, the controller 200 or processor 300 generates a mechanical adjustment command. The mechanical adjustment command may control any combination of the push tongue driver 211, a wire tool driver 213, and/or a tensioner driver 215. The push tongue driver 211 may include an actuator, motor, solenoid or another device to move the push tongue 102. Similarly, the wire tool driver 213 may include an actuator, motor, solenoid or another device to move the wire form tool 110. Also, the tensional driver 215 may include a motor or other device to operate the tensioner 119.

At act S105, the controller 200 or processor 300 generates a non-contact energy command. The non-contact energy command instructs the energy device 201 (e.g., laser or x-ray) to generate a pulse. The non-contact energy command may specify the timing, duration, wavelength, or another property of the pulse. The non-contact energy command may specify the number of pulses, the time between pulses, or the relative strength of the pulses.

At act S107, the process may repeat in various techniques. For example, when multiple pins are included in the instruction of S101, the process may return S105 for each pin. In other words, the controller 200 or processor 300 may set a counter value I that increments for each pulse or set of pulse as the energy device 101 moves under a stepper motor from one pin to the next. When the counter reaches the max number of pins K, the process returns to S103, where another mechanical command is generated to move any combination of the push tongue driver 211, a wire tool driver 213, and/or a tensioner driver 215, and prepare for alignment of the next package.

The processor 303 may include a general processor, digital signal processor, an application specific integrated circuit (ASIC), field programmable gate array (FPGA), analog circuit, digital circuit, combinations thereof, or other now known or later developed processor. The processor 303 may be a single device or combinations of devices, such as associated with a network, distributed processing, or cloud computing.

The memory 301 may be a volatile memory or a non-volatile memory. The memory 301 may include one or more of a read only memory (ROM), random access memory (RAM), a flash memory, an electronic erasable program read only memory (EEPROM), or other type of memory. The memory 301 may be removable from the network device 300, such as a secure digital (SD) memory card.

The network may include wired networks, wireless networks, or combinations thereof. The wireless network may be a cellular telephone network, an 802.11, 802.16, 802.20, or WiMax network. Further, the network may be a public network, such as the Internet, a private network, such as an intranet, or combinations thereof, and may utilize a variety of networking protocols now available or later developed including, but not limited to TCP/IP based networking protocols.

An input device to the controller 300 may be one or more buttons, keypad, keyboard, mouse, stylus pen, trackball, rocker switch, touch pad, voice recognition circuit, or other device or component for inputting data. The input device and a display may be combined as a touch screen, which may be capacitive or resistive. The display may be a liquid crystal display (LCD) panel, light emitting diode (LED) screen, thin film transistor screen, or another type of display.

While the computer-readable medium may be shown to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding or carrying a set of instructions for execution by a processor or that cause a computer system to perform any one or more of the methods or operations disclosed herein.

In a particular non-limiting, example embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to capture carrier wave signals such as a signal communicated over a transmission medium. A digital file attachment to an e-mail or other self-contained information archive or set of archives may be considered a distribution medium that is a tangible storage medium. Accordingly, the disclosure is considered to include any one or more of a computer-readable medium or a distribution medium and other equivalents and successor media, in which data or instructions may be stored. The computer-readable medium may be non-transitory, which includes all tangible computer-readable media.

In an alternative embodiment, dedicated hardware implementations, such as application specific integrated circuits, programmable logic arrays and other hardware devices, can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

Although the present specification describes components and functions that may be implemented in particular embodiments with reference to particular standards and protocols, the invention is not limited to such standards and protocols. For example, standards for Internet and other packet switched network transmission (e.g., TCP/IP, UDP/IP, HTML, HTTP, HTTPS) represent examples of the state of the art. Such standards are periodically superseded by faster or more efficient equivalents having essentially the same functions. Accordingly, replacement standards and protocols having the same or similar functions as those disclosed herein are considered equivalents thereof.

A computer program (also known as a program, software, software application, script, or code) can be written in any form of programming language, including compiled or interpreted languages, and it can be deployed in any form, including as a standalone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read only memory or a random access memory or both. The essential elements of a computer are a processor for performing instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. However, a computer need not have such devices.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings and described herein in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. §1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

It is intended that the foregoing detailed description be regarded as illustrative rather than limiting and that it is understood that the following claims including all equivalents are intended to define the scope of the invention. The claims should not be read as limited to the described order or elements unless stated to that effect. Therefore, all embodiments that come within the scope and spirit of the following claims and equivalents thereto are claimed as the invention.

We claim:

1. An apparatus comprising:

a common mode choke base configured to support a common mode choke;

a plurality of terminal contacts coupled to the common mode choke base, wherein the plurality of terminal contacts are each aligned with a wire connected to the common mode choke, and wherein at least one of the plurality of terminal contacts includes a top surface with an alignment portion, the alignment portion configured to align and support the wire on the top surface and further support a weld within, securing the wire to the at least one of the plurality of terminal contacts; and a support member including a wire supporting portion aligned with the wires connected to the common mode choke and a central portion configured to support the common mode choke base.

2. The apparatus of claim 1, wherein the plurality of terminal contacts are configured to receive a wire form tool that presses the wires against the plurality of terminal contacts.

3. The apparatus of claim 1, further comprising:

a plurality of grooves on the common mode choke base to aid in alignment of the wires.

4. The apparatus of claim 1, wherein a portion of the at least one of the plurality of terminal contacts extends vertically from the common mode choke base, the top surface of the at least one of the plurality of terminal contacts extending continuously from a first side of the at least one of the plurality of terminal contacts to a second side of the at least one of the plurality of terminal contacts, and wherein the alignment portion of the top surface is concave.

5. The apparatus of claim 1, wherein the at least one of the plurality of terminal contacts supports the wire with which the at least one of the plurality of terminal contacts is aligned during a termination process, and a weld resulting from the termination process extends past and overhangs an edge of the at least one of the plurality of terminal contacts.

6. The apparatus of claim 1, wherein the common mode choke base is configured to receive a push tongue that presses the wires against the common mode choke base.

7. The apparatus of claim 6, wherein the wire supporting portion includes a friction holder configured to frictionally hold the wires in place.

8. The apparatus of claim 7, wherein the friction holder includes a triangular cross section to guide the wires.

9. The apparatus of claim 7, wherein the friction holder includes an elastic portion and a rigid portion.

10. The apparatus of claim 9, further comprising:

an adjustable tensioner configured to move the elastic portion with respect to the rigid portion.

11. An apparatus comprising:

a plurality of terminal contacts coupled to a common mode choke, wherein the plurality of terminal contacts are aligned with wires connected to the common mode choke;

a support member including a wire supporting portion aligned with the wires connected to the common mode choke and a central portion configured to support a base of the common mode choke; and an adjustable tensioner configured to move a comb of the wire supporting portion to frictionally hold the wires.

12. The apparatus of claim 11, wherein the plurality of terminal contacts are configured to receive a wire form tool that presses the wires against the plurality of terminal contacts.

13. The apparatus of claim 12, wherein the base of the common mode choke is configured to receive a push tongue that presses the wires against the base of the common mode choke.

14. A method comprising:

coupling a plurality of terminal contacts to a common mode choke, wherein the plurality of terminal contacts are aligned with wires connected to the common mode choke;

connecting a support member including a wire supporting portion aligned with the wires to the common mode choke and a central portion configured to support a base of the common mode choke; and adjusting a tensioner to move a comb of the wire supporting portion to frictionally hold the wires.

15. The method of claim 14, further comprising:

receiving, by the plurality of terminal contacts, a wire form tool that presses the wires against the plurality of terminal contacts.

16. The method of claim 14, further comprising:

receiving, by the common mode choke, a push tongue that presses the wires against the base of the common mode choke.

17. The method of claim 14, further comprising:

receiving, by the plurality of terminal contacts within a concave portion, at least one of the wires.

18. The method of claim 14, further comprising:

supporting, by at least one of the plurality of terminal contacts, at least one of the wires during a termination process, wherein a top surface of the at least one of the plurality of terminal contacts results in a weld that extends past and overhangs an edge of the at least one of the plurality of terminal contacts.

19. The method of claim 14, wherein the wire supporting portion includes a friction holder frictionally holding the wires in place.

20. The method of claim 19, wherein the friction holder includes a triangular cross section to guide the wires.

* * * * *